US009726204B2

(12) United States Patent
Kajinami et al.

(10) Patent No.: US 9,726,204 B2
(45) Date of Patent: Aug. 8, 2017

(54) FLUID PRESSURE ACTUATOR

(71) Applicant: Samsung Electronics Co., Ltd., Suwon-Si, Gyeonggi-Do (KR)

(72) Inventors: Masato Kajinami, Kanagawa (JP); Fumitaka Moroishi, Kanagawa (JP); Keiji Murata, Kanagawa (JP); Shinji Ueyama, Kanagawa (JP); Tatsuya Ishimoto, Kanagawa (JP); Yoshiaki Yukimori, Kanagawa (JP)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 311 days.

(21) Appl. No.: 14/562,179

(22) Filed: Dec. 5, 2014

(65) Prior Publication Data

US 2015/0159681 A1 Jun. 11, 2015

(30) Foreign Application Priority Data

Dec. 9, 2013 (JP) ..... 2013-254482
Aug. 18, 2014 (KR) ..... 10-2014-0106961

(51) Int. Cl.
*F01B 31/12* (2006.01)
*F15B 15/08* (2006.01)
(Continued)

(52) U.S. Cl.
CPC ..... *F15B 15/088* (2013.01); *F15B 15/063* (2013.01); *F15B 15/2846* (2013.01); *F15B 15/1452* (2013.01); *F15B 15/1461* (2013.01); *F15B 15/2876* (2013.01); *F15B 2211/6336* (2013.01); *F15B 2211/665* (2013.01); *F15B 2211/6651* (2013.01); *F15B 2211/8855* (2013.01)

(58) Field of Classification Search
CPC ..... F15B 15/063; F15B 15/088; F15B 15/28; F15B 15/2846
See application file for complete search history.

(56) References Cited

U.S. PATENT DOCUMENTS 5,634,390 A 6/1997 Takeuchi et al.
6,951,104 B2 10/2005 Stobrawe et al.
(Continued)

FOREIGN PATENT DOCUMENTS

JP 2756096 B2 5/1998
JP 3437603 B2 8/2003
(Continued)

*Primary Examiner* — Michael Leslie
(74) *Attorney, Agent, or Firm* — Harness, Dickey & Pierce, P.L.C.

(57) ABSTRACT

A fluid pressure actuator including a fluid pressure cylinder having a first position detector and a second position detector, a piston body having a piston head and a rod, the piston head mounted on the rod and slidably accommodated in the fluid pressure cylinder, the rod including a first scale and a second scale, the first scale facing the first position detector and the first position detector configured to detect a position in a sliding direction of the piston body, the second scale facing the second position detector and the second position detector configured to detect a position of the rod in a rotation direction of the piston body, and a controller configured to perform a first positioning control of a position of the rod in the sliding direction and a second positioning control of the rod in the rotation direction may be provided.

19 Claims, 4 Drawing Sheets

(51) Int. Cl.

| | |
|---|---|
| ***F15B 15/28*** | (2006.01) |
| ***F15B 15/06*** | (2006.01) |
| *F15B 15/14* | (2006.01) |

(56) References Cited

U.S. PATENT DOCUMENTS

| | | | |
|---|---|---|---|
| 2004/0007125 | A1 | 1/2004 | Stobrawe et al. |
| 2009/0007626 | A1 | 1/2009 | Bochen et al. |
| 2011/0084559 | A1 | 4/2011 | Finkbeiner |

FOREIGN PATENT DOCUMENTS

| | | | |
|---|---|---|---|
| JP | 4268431 | B2 | 5/2009 |
| JP | 2011069384 | A | 4/2011 |

FLUID PRESSURE ACTUATOR

CROSS-REFERENCE TO RELATED APPLICATIONS

This application claims priority to Japanese Patent Application No. 2013-0254482, filed on Dec. 9, 2013, in the Japanese Patent Office, and Korean Patent Application No. 10-2014-0106961, filed on Aug. 18, 2014, in the Korean Intellectual Property Office, the disclosures of which are incorporated herein in their entireties by reference.

BACKGROUND

Some example embodiments relates to fluid pressure actuators.

For example, Japanese Patent Publication Application No. 2004-301138 discloses a fluid pressure actuator provided in a mounting head of an apparatus (e.g., die-bonder, mounter, etc.), which is used in a post-process of manufacturing a semiconductor chip. The mounting head is provided to mount semiconductor chip thereon, and the actuator enables load control and position control of the mounting head.

FIG. 1A is a schematic diagram showing a cross-sectional configuration of a fluid pressure actuator according to the related art. FIG. 1B is a diagram illustrating an operation of a controller included in a fluid pressure actuator according to the related art.

A fluid pressure actuator 90 shown in FIG. 1 includes a cylinder 10, a piston body 50, and a servo valve 60. The cylinder 10 includes a cylinder body 11, a guide flange or a housing 13, and a ball bearing 30. The piston body 50 includes a piston head 51 and a rod 52, In the fluid pressure actuator 90, an axial direction sensor 41 (which includes an axial direction scale 41-1 and an axial direction detector 41-2) is configured to detect a position when the piston body 50 moves in an axial direction (e.g., Z direction shown in FIG. 1A). The axial direction sensor 41 is configured to output a detection signal ΦDZ indicating a position in the axial direction. Referring to FIG. 1B, a controller 80 is configured to control pressure within the cylinder 10 by using the servo valve 60 on the basis of the detection signal ΦDZ, and may control the position of the rod 52, serving as a movable portion, in the axial direction.

Further, a fluid pressure bearing portion (gap between the rod 52 and the guide flange 13) may have a polygonal shape and be configured to enable transmission of the rotation of a rotation motor 71 to the rod 52 in a non-contact manner, as shown in FIG. 2. For example, the rotation motor 71 (e.g., step motor, servo motor, etc.) may be provided outside the cylinder 10, and the rotation of the rotation motor 71 may be transmitted to the guide flange 13 through a timing belt 72 and a pulley 73, thereby rotating the rod 52. Thus, the controller 80 may control the rotation of the rod 52 based on a detection signal ΦDθ (which is a detection signal indicating a rotation angle the rotation motor 71 with respect to an axis of rotation), which is output from an encoder 75 provided in the rotation motor 71. Meanwhile, a hollow direct drive (DD) motor may be used as the rotation motor 71 so that the rotation of the rod is controlled without using the timing belt 72 and the pulley 73 with respect to the axis of rotation (e.g., Z direction) of the piston body 50.

According to the related art described above, the rotation of the rotation motor 71 is transmitted through the fluid pressure bearing portion having a polygonal shape, but an angular movement amount (which is an angle based on the rotation of the rod 52) of the rod 52 in a rotation direction of the rod is not taken account. The angular movement amount is detected using the encoder 75, which is included in the rotation motor 71 provided outside the fluid pressure actuator 90, as a position detector.

FIG. 2 is diagrams for explaining a problem of a fluid pressure actuator according to the related art. In FIG. 2, a diagram in the left shows a state where the rod 52 and the guide flange 13 that are not in motion and a diagram in the right shows a state where the guide flange 13 is rotated clockwise by an angular movement amount θ from the position by rotating the rotation motor 71.

As shown in FIG. 1A, an encoder 75 (e.g., a scale and a detector) is provided outside the cylinder 10. Accordingly, when the guide flange 13 is rotated by the angular movement amount θ, the rod 52 may be rotated with a rotation deviation amount 6 from the angular movement amount θ due to a gap between the rod 52 and the guide flange 13. For example, the gap may include a fluid pressure bearing portion. However, the encoder 75 provided in the rotation motor 71 provided outside the rod 52 may detect the angular movement amount θ of the guide flange 13, but may not detect an angular movement amount (θ+δ) of the rod 52 that includes a rotational deviation with the guide flange 13 of the rod 52.

Because the encoder 75 (e.g., scale and the detector) is provided outside the cylinder 10 (which is a rotation driving side), the encoder 75 cannot precisely detect an actual position of the rod 52 due to the gap between the rod 52 and the guide flange 13, in which, for instance, a fluid is interposed, operates an error factor. Accordingly, a mounting failure may occur, for instance, when bonding a bump to a miniaturized semiconductor chip (driven part coupled to the rod 52) by a rotation error caused by the error factor.

SUMMARY

Some example embodiments provide fluid pressure actuators, each of which is capable of detecting an angular movement amount (the above-mentioned (δ+δ)) of a rod and is capable of controlling a position of the rod in the rotation direction with high accuracy.

According to an example embodiment, a fluid pressure actuator includes a fluid pressure cylinder including a first position detector and a second position detector, a piston body having a piston head and a rod, the piston head mounted on the rod and slidably accommodated in the fluid pressure cylinder, the rod including a first scale and a second scale, the first scale facing the first position detector and the first position detector configured to detect a position in a sliding direction of the piston body, the second scale facing the second position detector and the second position detector configured to detect a position of the rod in a rotation direction of the rod, and a controller configured to perform a first positioning control of a position of the rod in the sliding direction and a second positioning control of the rod in the rotation direction.

According to some example embodiments, the second scale may have a cylindrical shape and is provided such that an axis of rotation thereof is the same as an axis of rotation of the piston body, and the second scale has rectangular patterns running parallel to each other are at a circumferential side surface of the cylindrical shape.

According to some example embodiments, the first scale and the second scale may have a cylindrical shape and are provided such that an axis of rotation of the first scale and an axis of rotation of the second scale are the same as an axis of rotation of the piston body and at least one circumferential side surface of the first scale and the second scale has a grid pattern.

According to an example embodiment, a fluid pressure actuator includes a fluid pressure cylinder, a piston body having a rod, the rod including a first scale and slidably and rotatably accommodated in the fluid pressure cylinder, a first position detector corresponding to the first scale and configured to detect a position of the rod in a rotation direction of the rod together with the first scale, a guide flange connected to the fluid pressure cylinder, the guide flange configured to guide the sliding and rotation of the piston body, and a controller configured to control a position of the rod.

According to some example embodiments, an axis of rotation of the first scale may be the same as an axis of rotation of the piston body, and a circumferential side surface of the first scale may have patterns parallel to each other along the rotation direction.

According to some example embodiments, the piston body may further include two piston heads in a sliding direction of the piston body, and the first scale may be provided between the two piston heads along the sliding direction.

According to some example embodiments, a hole may be defined inside the fluid pressure cylinder in the sliding direction, and the first scale may be provided as an extension portion of the piston body such first scale is inserted into the hole.

According to some example embodiments, the fluid pressure actuator may further include a second scale and a second position detector, which corresponds to the second scale and is configured to detect a position of the rod in a sliding direction of the rod.

According to some example embodiments, the second scale may have patterns, which are parallel to each other, on its surface along the sliding direction.

According to some example embodiments, a hole may be defined inside the fluid pressure cylinder in the sliding direction, and the second scale may be provided as a first extension portion of the piston body such that the second scale is inserted into the hole.

According to some example embodiments, the first scale may be provided as a second extension portion of the piston body.

According to some example embodiments, each of the first scale and the second scale may have a grid pattern in its surface.

According to some example embodiments, the guide flange may have a circular shape in a cross-section along a direction perpendicular to the sliding direction, and the rod may have a polygonal shape.

According to some example embodiments, the first position detector may be configured to detect an angular movement amount of the rod corresponding to the position of the rod in the rotation direction.

According to some example embodiments, the fluid pressure actuator may further include a rotation motor outside the guide flange, and an encoder in the rotation motor, the encoder configured to detect an angular movement amount of the guide flange.

According to an example embodiment, a fluid pressure actuator includes a cylinder, a piston body having a first piston head and a rod, the first piston head mounted on the rod and slidably accommodated in the cylinder, the rod including an axial direction sensor and a rotation direction sensor, and a controller configured to a controller configured to perform a first positioning control of the rod in a sliding direction thereof based on a displacement amount from the axial direction sensor, and a second positioning control of the rod in a rotation direction thereof based on an angular movement amount from the rotation direction sensor.

According to some example embodiments, the fluid pressure actuator may further include a guide flange connected to the cylinder and configured to guide rotation of the piston body in a rotation direction thereof and the piston head may be configured to slide in the cylinder.

According to some example embodiments, the fluid pressure actuator may further include a servo valve connected to the cylinder, and a rotation motor separately provided outside the cylinder. The controller may be configured to control the servo valve to perform the first positioning control based on the displacement amount and control the rotation motor to perform the second positioning control based on the angular movement amount.

According to some example embodiments, the axial direction sensor may include an axial direction scale and an axial direction detector. The axial direction scale may be attached to the rod. The axial direction detector may face the axial direction scale and may be configured to detect signal reflected from the axial direction scale and output a first detection signal indicating the displacement distance, and rotation direction sensor may include a rotation direction scale and a rotation direction detector. The rotation direction scale may be configured to rotate about a same axis as the piston body. The rotation direction detector may be configured to detect signal reflected from the rotation direction scale and output a second detection signal indicating the angular movement amount.

According to some example embodiments, the rotation direction sensor and the axial direction sensor may be integrally provided as an axial direction and rotational direction sensor, and the axial direction and rotational direction sensor may include an axial direction and rotation direction scale and an axial direction and rotation direction detector.

BRIEF DESCRIPTION

Example embodiments of the present inventive concepts will be more clearly understood from the following detailed description taken in conjunction with the accompanying drawings in which.

DETAILED DESCRIPTION

Figure 1A:
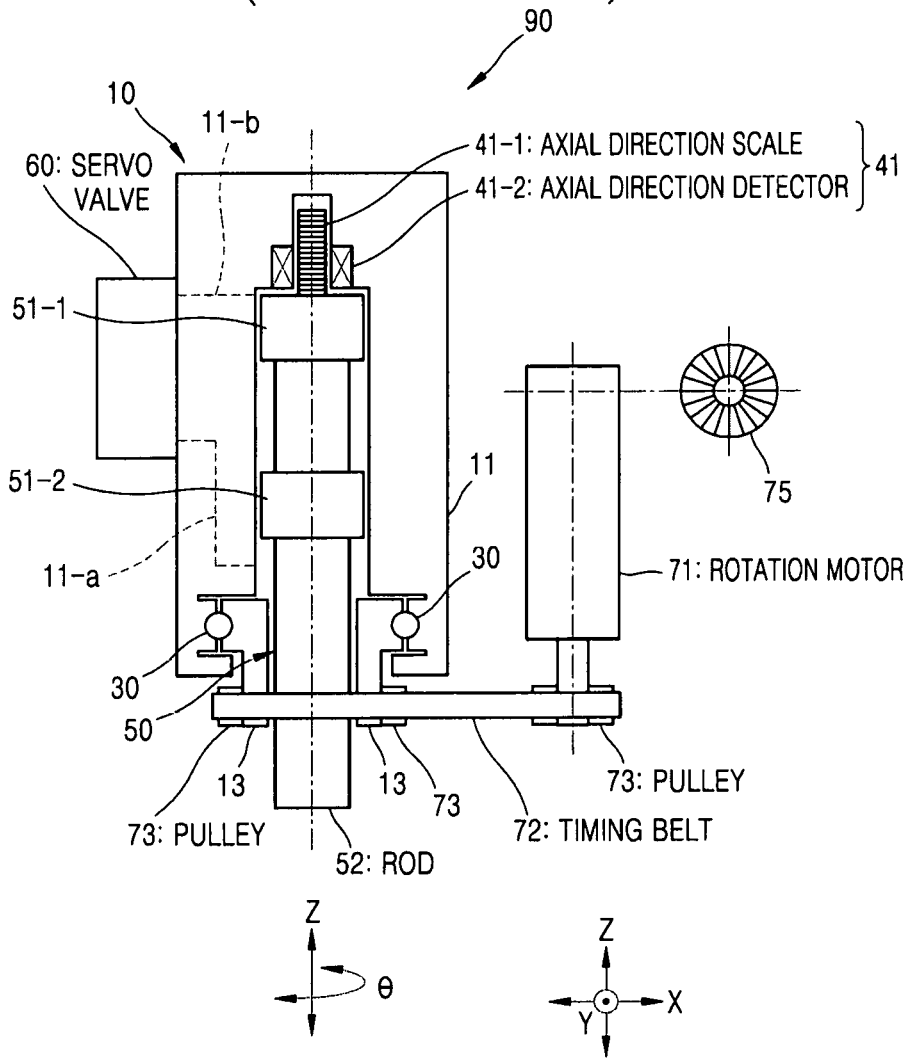
FIG. 1A (RELATED ART)
FIG. 1A is a schematic diagram showing a cross-sectional configuration of a fluid pressure actuator according to the related art.

Various example embodiments will be described more fully hereinafter with reference to the accompanying drawings, in which some example embodiments are shown. The present disclosure may, however, be embodied in many different forms and should not be construed as limited to the example embodiments set forth herein. Rather, these example embodiments are merely provided so that this disclosure will be thorough and complete, and will fully convey the scope of example embodiments to those skilled in the art. In the drawings, the sizes and relative sizes of the various layers and regions may have been exaggerated for clarity. Like numerals refer to like elements throughout.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. As used herein, the term "and/or" includes any and all combinations of one or more of the associated listed items. Expressions such as "at least one of," when preceding a list of elements, modify the entire list of elements and do not modify the individual elements of the list.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments. It should also be noted that in some alternative implementations, the functions/acts noted may occur out of the order noted in the figures.

First Example Embodiment

Figure 1B:
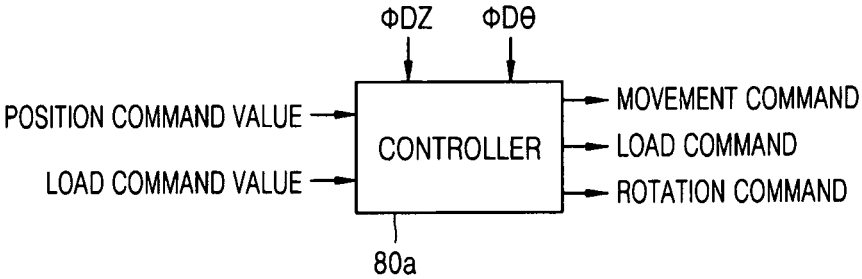
FIG. 1B (RELATED ART)
FIG. 1B is a diagram for illustrating an operation of a controller included in a fluid pressure actuator according to the related art.
Figure 3A:
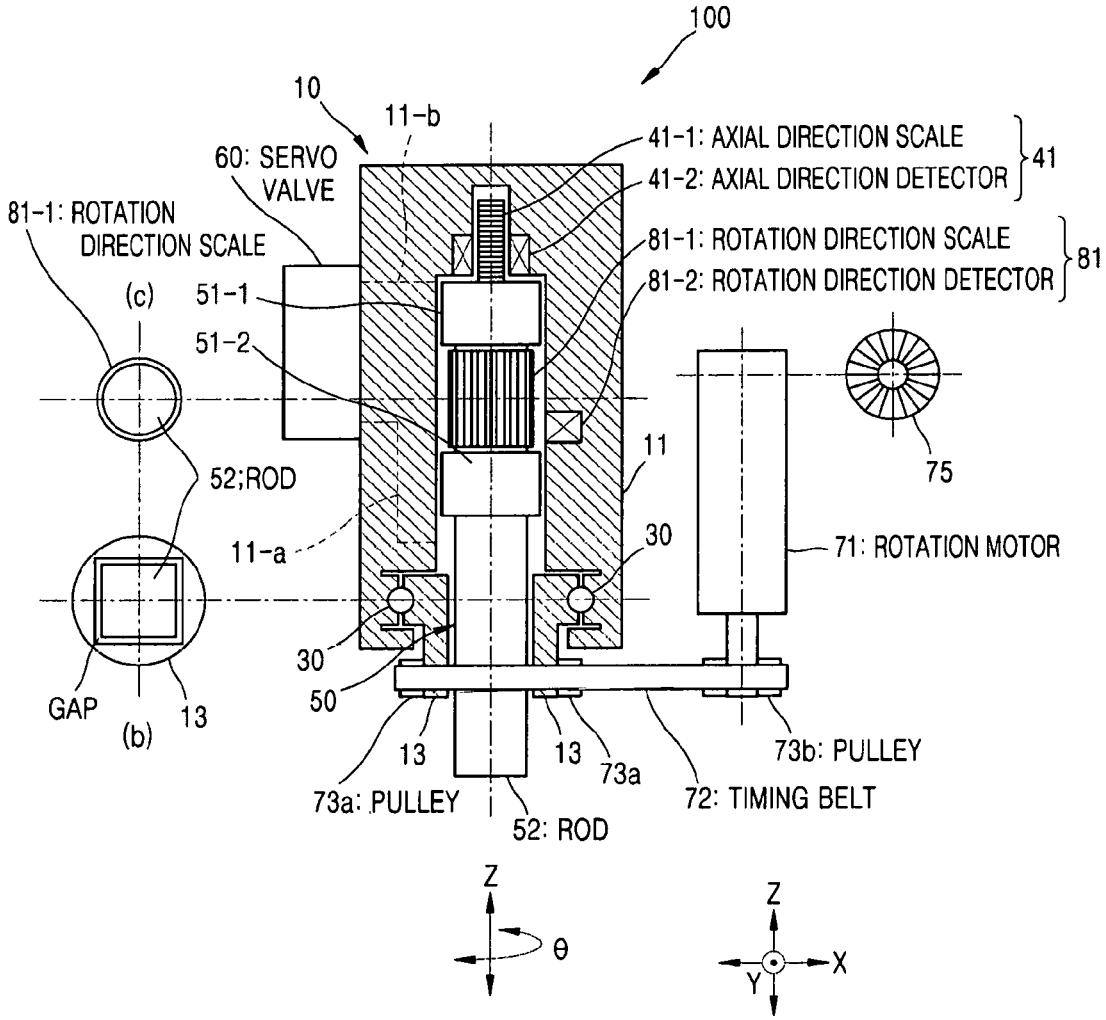
FIG. 3A is a schematic diagram showing a cross-sectional configuration of a fluid pressure actuator according to an example embodiment.
Figure 3B:
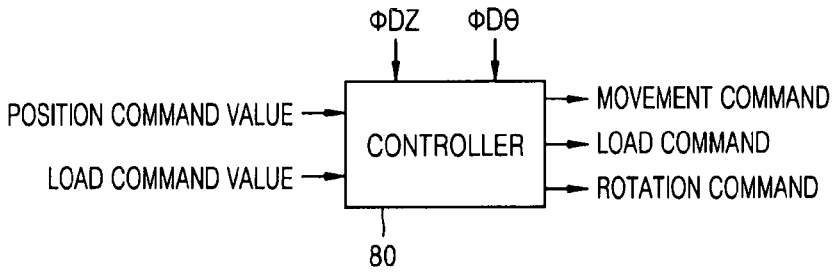
FIG. 3B is a diagram for illustrating an operation of a controller included in the fluid pressure actuator.

Hereinafter, some example embodiments of the inventive concepts will be described with reference to the accompanying drawings. FIG. 3A is a schematic diagram showing a cross-sectional configuration of a fluid pressure actuator 100 according to an example embodiment. FIG. 3 shows a cross-sectional structure of the fluid pressure actuator 100 in an XZ plane, (a) of FIG. 1 shows cross-sectional structures of a rod 52 and a guide flange 13 in an XY plane, and (b) of FIG. 1 shows cross-sectional structures of a rotation direction scale 81-1 and the rod 52 in the XY plane. FIG. 3B is a diagram for illustrating an operation of a controller 80*a* included in the fluid pressure actuator 100.

The fluid pressure actuator 100 includes a cylinder 10, a piston body 50, and a servo valve 60.

The cylinder 10 includes a cylinder body 11, the guide flange or housing 13, and a ball bearing 30.

The piston body 50 includes piston heads 51 (which includes a first piston head 51-1 and a second piston head 51-2) and the rod 52. The piston head 51-1 and the piston head 51-2 may be mounted on the rod 52. Further, an axial direction scale 41-1 and the rotation direction scale 81-1 may be mounted on the rod 52.

In the cylinder body 11, a pressure chamber may be formed between the piston heads 51 (piston head 51-1 and piston head 51-2). In the guide flange 13, a pressure chamber may be formed between the rod 52 and the ball bearing 30. Further, the cylinder body 11 may include a passage 11-*a* serving as an air inlet from the servo valve 60 to the pressure chamber and a passage 11-*b* serving as an air outlet from the pressure chamber to the servo valve 60. Hereinafter, the pressure chamber on a lower portion of FIG. 3A that includes the passage 11-*a* and the piston head 51-2 may be referred to as a constant pressure chamber, and the pressure chamber on an upper portion of FIG. 3A that includes the passage 11-*b* of the piston head 51-1 may be referred to as an adjustment pressure chamber. The cylinder body 11 may be provided with an air inlet (not shown), and thus air with a constant pressure may be introduced into the constant pressure chamber from an external compressed air supply source.

The cylinder body 11 has a space having a circular cross-section, and the piston heads (e.g., the first piston head 51-1 and the second piston head 51-2) each having a circular cross-section may be inserted into and moves through the space. Meanwhile, the guide flange 13 has a hole having a polygonal cross-section (e.g., a quadrangular cross-section), and the rod 52 having a quadrangular cross-section may be inserted into and move through the hole such that the rod slides in an axial direction, for instance, along an axis of rotation (e.g., Z axis) of the rod 52 or piston body 50.

The movement of the guide flange 13 may be suppressed along the axial direction, but the guide flange 13 may be held within the constant pressure chamber so as to be rotated with respect to the axis of rotation of the piston body 50 using the ball bearing 30. Thus, the rod 52 may be configured to be slidable in the axial direction with respect to the guide flange 13 and be rotatable together with the guide flange 13 when the guide flange 13 is rotated. Further, the guide flange 13 may have a boss (not shown) which protrudes in the Z-axis direction, and a pulley 73*a* may be coupled to the boss. Meanwhile, a pulley 73*b* may be connected to the rotation motor 71. When the rotation motor 71 rotates, the rotation of the motor may be transmitted to the pulley 73*a* through the timing belt 72, thereby rotating the pulley 73*a* with respect to the Z-axis direction on the XY plane.

As described above, the constant pressure chamber may be provided between the rod 52 and the guide flange 13. Thus, when compressed air is introduced thereinto, a fluid pressure bearing portion for floating the rod 52 from an inner wall surface of the guide flange 13 may be provided. Accordingly, the rod 52 of the piston body 50 may have a quadrangular cross-section so as not to freely rotate about the guide flange 13, while the guide flange 13 may be configured to be rotatable about the axis of rotation (e.g., Z axis) of the piston body 50 through the ball bearing 30. Thus, when the pulley 73*a* is rotated, the rod 52 and the guide flange 13 are integrated into one body and are rotatable about the —axis of rotation of the piston body 50.

Further, shallow grooves for introducing compressed air from the adjustment pressure chamber and/or the constant pressure chamber may be formed on circumferential side surfaces of the first piston head 51-1 and the second piston head 51-2 in a circumferential direction at intervals, thereby providing a fluid pressure bearing portion, which keeps the piston heads 51-1 and 51-2 separated from an inner wall of the cylinder body 11. The fluid pressure bearing portion may cause the compressed air introduced from the adjustment pressure chamber and the constant pressure chamber to act on the inner wall of the cylinder body 11. Thus, the piston heads 51-1 and 51-2 may be separated from the inner wall of the cylinder body 11, and the piston heads 51-1 and 51-2 may slide and rotate in a non-contact manner.

Although not shown in FIG. 1, exhaust grooves for exhausting air acting on the inner wall of the cylinder body 11 may be formed on the circumferential side surfaces of at least one of the first piston head 51-1 and the second piston head 51-2 in the vicinity of the fluid pressure bearing portion, and the compressed air collected in the exhaust grooves may be discharged outside the actuator from an end of the rod 52 through an exhaust passage formed within the piston body 50.

The controller 80*a* may control the servo valve 60 to control a fluid from the constant pressure chamber to the adjustment pressure chamber, thereby performing the position control operation and load control operation with regard to the piston body 50 in the Z-axis direction with improved accuracy. Here, the load control operation refers to controlling a load (e.g., force) applied to the piston body 50 based on a load command value to a driven part (e.g., a semiconductor chip) provided in the end of the rod 52, according to, for example, the following formula:

$$F=P1\cdot S1-P\cdot S$$

where F denotes the load, a pressure-receiving area of the first piston head 51-1 facing the adjustment pressure chamber is set to S1, pressure acting thereon is set to P1, a pressure-receiving area of the second piston head 51-2 facing the constant pressure chamber is set to S (where S1>S), and pressure acting thereon is set to P (here, P>P1).

An axial direction sensor 41 and a rotation direction sensor 81 are provided in order for the controller 80*a* to perform a first portion of the position control operation in the Z axis (e.g., a central axis of the piston body 50 in the longitudinal direction of the piston body 50) direction by controlling the servo valve 60 and to perform a second portion of the position control operation in a rotation direction with respect to the Z axis by controlling the rotation motor 71.

The axial direction sensor 41 may include an axial direction scale 41-1 and an axial direction detector 41-2 which detects, together with the axial direction scale 41-1, position of the piston body 50 in the sliding direction thereof.

A hole may be provided in a direction of the central axis of the piston body 50 and at a side opposite to the guide flange 13 of the cylinder body 11, and the axial direction scale 41-1, which is fixed to, for example, the center of the rod 52 and extending in the central axis direction may be inserted or accommodated into the hole. The axial direction scale 41-1 may be provided as a portion extending from the piston body 50, and may be accommodated into the hole. In some example embodiments, the rotation direction scale 81-1 may be provided as a portion extending from the piston body 50, and may be accommodated into the hole. The axial direction detector 41-2, which detects the position of the piston body 50 together with the axial direction scale 41-1, also may be fixed to the side opposite to the guide flange 13 of the cylinder body 11. In the axial direction scale 41-1, a magnetic body and a non-magnetic body may be alternately arranged at a desired (or alternatively, predetermined) pitch.

When the axial direction scale 41-1 moves in the Z-axis direction together with the piston body 50, the number of magnetic bodies having moved to the Z-axis direction in the axial direction scale 41-1 may be detected by the axial direction detector 41-2. The axial direction detector 41-2 may output a first detection signal ΦDZ indicating a distance from a reference position in the Z-axis direction to the controller 80*a*. The controller 80*a* may control the servo valve 60 using the first detection signal ΦDZ and control the position of the piston body 50 in the Z-axis direction. For example, the axial direction sensor 41 may be an optical sensor, similar to the rotation direction sensor 81.

The rotation direction sensor 81 may include a rotation direction scale 81-1 and a rotation direction detector 81-2 which detects, together with the rotation direction scale 81-1, position of the rod 52 in the rotation direction of the piston body 50.

The rotation direction scale 81-1 may be fixed to the rod 52 between the first piston head 51-1 and the second piston head 51-2 of the rod 52. The rotation direction scale 81-1 may be provided as a portion of the piston body 50. The rotation direction scale 81-1 may be formed of a metal or glass. The rotation direction scale 81-1 may have a cylindrical shape and may be provided such that the an axis of rotation of the rotation direction scale 81-1 is the same as the central axis or the axis of rotation of the piston body 50. For example, the cylindrical shape of the rotation direction scale 81-1 may have rectangular patterns running parallel to each other at a circumferential side surface thereof. When the rotation direction scale 81-1 is formed of a metal, the pattern may be a groove which is carved into the circumferential side surface of the rotation direction scale 81-1. When the rotation direction scale 81-1 is formed of glass, the pattern may have a shape printed on the circumferential side surface of the rotation direction scale 81-1. Further, the rotation direction detector 81-2, which is used for detecting the position of the piston body 50 in the rotation direction, may be fixed to a portion of the cylinder body 11 that faces the rotation direction scale 81-1. For example, the rotation direction sensor 81 may be an optical sensor, similar to the axial direction sensor 41.

When the rotation direction scale 81-1 rotates about the Z axis together with the piston body 50, the rotation direction detector 81-2 may include a light projection unit, which emits light (e.g., visible light or infrared light) as signal light, and a light-receiving unit, which detects the light reflected by the rotation direction scale 81-1. The rotation direction detector 81-2 may outputs a second detection signal ΦDθ indicating a rotation angle from a reference position in the rotation direction of the piston body 50. The controller 80*a* may control the rotation motor 71 by using the second detection signal ΦDθ and control the position in the rotation direction of the piston body 50.

A desired position value for the position control operation and a desired load value for the control operation from the outside (e.g., a user or a processor), the first detection signal (ΦDZ from the axial direction sensor 41, and the second detection signal ΦDθ from the rotation direction sensor 81 may be input to the controller 80*a*, and the controller may output a movement command and a load command to the servo valve 60 and output a rotation command to the rotation motor 71.

The controller 80*a* may output the movement command to the servo valve 60 to eliminate a difference between the desired position value and the detection signal ΦDZ may be eliminated. The controller 80*a* may output the load command to the servo valve 60 to eliminate a difference between the desired load value and a pressure difference value between the adjustment pressure P1 and the constant pressure P2. The servo valve 60 may control a fluid entering the adjustment pressure chamber to perform positioning (positioning in the −Z axis direction) of the piston body 50 with improved accuracy. Further, the controller 80*a* may output the rotation command to the rotation motor 71 to eliminate a difference between the desired position value and the second detection signal ΦDθ, thereby performing positioning in the rotation direction of the piston body 50 with improved accuracy. The rotation may be controlled such that a difference between the output of the encoder 75 of the rotation motor 71 and the second detection signal ΦDθ from the rotation direction sensor 81 is eliminated.

The controller 80*a* may switch operations—between the position control operation and the load control operation of the piston body 50. For example, the controller 80*a* may perform the position control operation with regard to the piston body 50, on which the driven part (e.g., a semiconductor chip) is positioned at a desired (or alternatively, predetermined) location during the control—and then the controller 80*a* may switch its operation to the load control operation and apply a desired (or alternatively, predetermined) load or force to the piston body 50 on which the driven part is positioned. According to some example embodiments, the controller may only perform one of the position control operation and the load control operation.

As described above, the fluid pressure actuator 100 may include the cylinder 10 (e.g., fluid pressure cylinder), the piston body 50 may include the piston heads 51-1 and 51-2 slidably accommodated in the cylinder 10, and the controller 80*a* for controlling the position of the driven part may be coupled to the rod 52 of the piston body 50. The rod 52 may include the axial direction scale 41-1 and the rotation direction scale 81-1. The cylinder 10 may include the rotation direction detector 81-2 (e.g., first position detector) that detects, together with the rotation direction scale 81-1, the position of the rod 52 in a rotation direction, and the axial direction detector 41-2 (e.g., second position detector) that detects, together with the axial direction scale 41-1, the position of the rod 52 in the sliding direction of the piston body 50.

According to the foregoing example embodiment, a fluid pressure actuator may perform a piston control operation to position a driven part located on a mounting head of an apparatus in terms of a linear movement and a rotational movement with improved accuracy. Further, a fluid pressure actuator may perform a load control operation. According to the foregoing example embodiments, because a rod of the fluid pressure actuator 100 has a rotation direction scale, an angular movement amount (θ+δ) of the rod 52 may be detected, thereby providing a fluid pressure actuator capable of controlling the position of the rod 52 in a rotation direction with improved accuracy.

Another Example Embodiment

Figure 2:
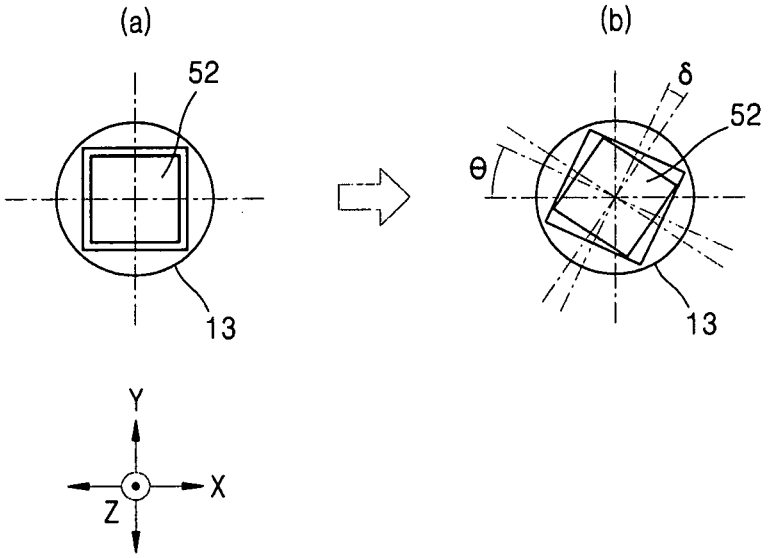
FIG. 2 (RELATED ART)
FIG. 2 is diagrams for explaining a problem of a fluid pressure actuator according to the related art.
Figure 4:
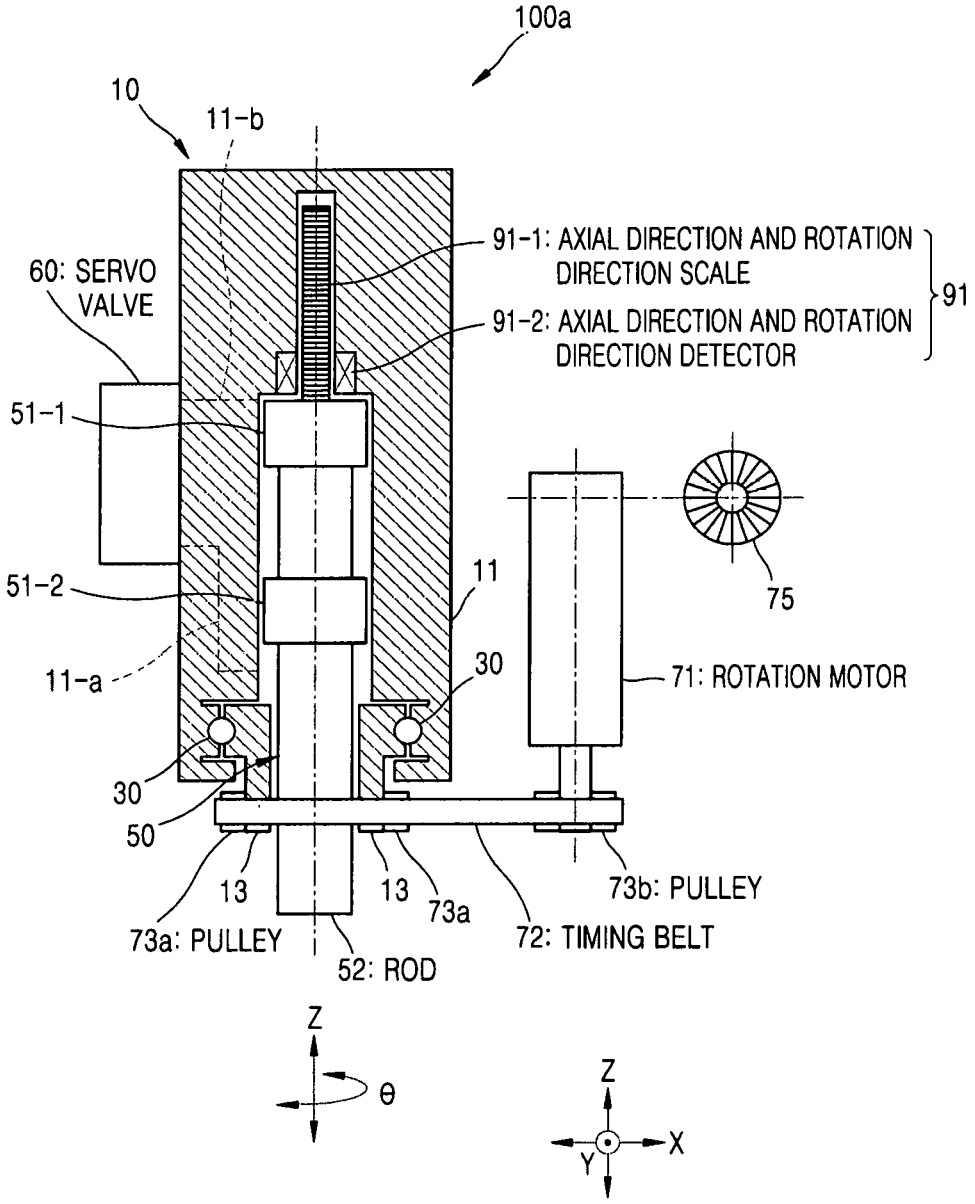
FIG. 4 is a diagram showing a configuration of a fluid pressure actuator according to another example embodiment.

Hereinafter, other example embodiments of the inventive concepts will be described with reference to the accompanying drawings. FIG. 4 is a diagram showing the configuration of a fluid pressure actuator 100*a* according to another exemplary embodiment. In the fluid pressure actuator 100*a* shown in FIG. 2, the same components as those of the fluid pressure actuator 100 shown in FIG. 1 will be denoted by the same reference numerals, and a description thereof will be omitted here.

In the fluid pressure actuator 100*a*, an axial direction and rotation direction sensor 91 is provided instead of the axial direction sensor 41 and the rotation direction sensor 81 in the fluid pressure actuator 100 shown in FIG. 1.

The axial direction and rotation direction sensor 91 includes an axial direction and rotation direction scale 91-1 and an axial direction and rotation direction detector 91-2 that detects, together with the axial direction and rotation direction scale 91-1, the position of a piston body 50 in the sliding direction and in the rotation direction of the piston body 50.

A hole may be provided in a direction of a central axis of the piston body 50 in a longitudinal direction thereof at a side opposite to the guide flange 13 of the cylinder body 11. The axial direction and rotation direction scale 91-1 may be fixed to, for example, the center of the rod 52 extending in the central axis direction and be inserted or accommodated into the hole. The axial direction and rotation direction detector 91-2, which detects the position of the piston body 50 together with the axial direction and rotation direction scale 91-1, also may be fixed to the side opposite to the guide flange 13 of the cylinder body 11. The axial direction and rotation direction scale 91-1 may be disposed between a first piston head 51-1 and a second piston head 51-2, similar to the fluid pressure actuator 100 shown in FIG. 3A.

Similarly to the rotation direction scale 81-1 shown in FIG. 3A, the axial direction and rotation direction scale 91-1 may be formed of a metal or glass. The axial direction and rotation direction scale 91-1 may have a cylindrical shape and may be provided such that an axis of rotation or the central axis thereof is the same as a central axis or an axis of rotation of the piston body 50. For example, the cylindrical shape of the axial direction and rotation direction scale 91-1 may have a grid pattern at a circumferential side surface thereof. When the axial direction and rotation direction scale 91-1 is formed of a metal, the pattern may be a groove which is carved into the circumferential side surface of the axial direction and rotation direction scale 91-1. When the axial direction and rotation direction scale 91-1 is formed of glass, the pattern may be a shape printed on the circumferential side surface of the axial direction and rotation direction scale 91-1.

When the axial direction and rotation direction scale 91-1 moves together with the piston body 50, the axial direction and rotation direction detector 91-2 may include a light projection unit, which emits light (e.g., visible light or infrared light) as signal light from, and a light-receiving unit, which detects the light reflected by the axial direction and rotation direction scale 91-1. The axial direction and rotation direction detector 91-2 may output detection signals ΦDZ and ΦDθ indicating a distance and an angle from respective reference positions in respective movement direction to the controller 80*a*. The controller 80*a* may control a servo valve 60 and a rotation motor 71 by using the detection signals ΦDZ and ΦDθ, thereby controlling the position of the piston body 50.

According to some example embodiments, the controller may be implemented using one or more hardware device configured to carry out and/or execute program code by performing arithmetical, logical, and input/output operations. The controller may include a processor, an arithmetic logic unit, a digital signal processor, a microcomputer, a field programmable array, a programmable logic unit, a microprocessor or any other device capable of responding to and executing instructions in a defined manner. The controller also may access, store, manipulate, process, and create data in response to execution of the software. For purpose of simplicity, the description of the controller is used as singular; however, one skilled in the art will appreciated that the controller may be implemented by multiple controllers. For example, the controller may include multiple processors or a combination of a processor and any other device. In addition, different processing configurations are possible, such a parallel controllers.

While some example embodiments have been particularly shown and described, it will be understood that various changes in form and details may be made therein without departing from the spirit and scope of the following claims.

What is claimed is:

1. A fluid pressure actuator comprising:

a fluid pressure cylinder including a first position detector and a second position detector;

a piston body having a piston head and a rod, the piston head mounted on the rod and slidably accommodated in the fluid pressure cylinder, the rod including a first scale and a second scale, the first scale facing the first position detector and the first position detector configured to detect a position in a sliding direction of the piston body, the second scale facing the second position detector and the second position detector configured to detect a position of the rod in a rotation direction of the piston body; and a controller configured to perform a first positioning control of a position of the rod in the sliding direction and a second positioning control of the rod in the rotation direction.

2. The fluid pressure actuator of claim 1, wherein the second scale has a cylindrical shape and is provided such that an axis of rotation thereof is the same as an axis of rotation of the piston body, and the second scale has rectangular patterns running parallel to each other at a circumferential side surface of the cylindrical shape.

3. The fluid pressure actuator of claim 1, wherein the first scale and the second scale have a cylindrical shape and are provided such that an axis of rotation of the first scale and an axis of rotation of the second scale are the same as an axis of rotation of the piston body and at least one circumferential side surface of the first scale and the second scale has a grid pattern.

4. A fluid pressure actuator comprising:

a fluid pressure cylinder;

a piston body having a rod, the rod including a first scale and slidably and rotatably accommodated in the fluid pressure cylinder;

a first position detector corresponding to the first scale and configured to detect a position of the rod in a rotation direction of the rod together with the first scale;

a guide flange connected to the fluid pressure cylinder, the guide flange configured to guide sliding and rotation of the piston body; and a controller configured to control a position of the rod.

5. The fluid pressure actuator of claim 4, wherein an axis of rotation of the first scale is the same as an axis of rotation of the piston body, and a circumferential side surface of the first scale has patterns parallel to each other along the rotation direction.

6. The fluid pressure actuator of claim 5, wherein the piston body further includes two piston heads in a sliding direction of the piston body, and the first scale is between the two piston heads along the sliding direction.

7. The fluid pressure actuator of claim 5, wherein a hole is defined inside the fluid pressure cylinder in a sliding direction, and the first scale is provided as a portion extending from the piston body such that the first scale is inserted into the hole.

8. The fluid pressure actuator of claim 4, further comprising:

a second scale; and a second position detector corresponding to the second scale and configured to detect a position of the rod in a sliding direction of the rod.

9. The fluid pressure actuator of claim 8, wherein the second scale has patterns, which are parallel to each other, on its surface along the sliding direction.

10. The fluid pressure actuator of claim 8, wherein a hole is defined inside the fluid pressure cylinder in the sliding direction, and the second scale is provided as a portion extending from the piston body such that the second scale is inserted into the hole.

11. The fluid pressure actuator of claim 10, wherein the first scale is provided as a portion of the piston body.

12. The fluid pressure actuator of claim 4, wherein the guide flange has a circular shape in a cross-section along a direction perpendicular to a sliding direction, and the rod has a polygonal shape.

13. The fluid pressure actuator of claim 12, wherein the first position detector is configured to detect an angular movement amount of the rod corresponding to the position of the rod in the rotation direction.

14. The fluid pressure actuator of claim 13, further comprising:

a rotation motor outside the guide flange; and an encoder in the rotation motor, the encoder configured to detect an angular movement amount of the guide flange.

15. A fluid pressure actuator comprising:

a cylinder including an axial direction detector and a rotation direction detector;

a piston body having a first piston head and a rod, the first piston head mounted on the rod and slidably accommodated in the cylinder, the rod including an axial direction scale facing the axial direction detector and a rotation direction scale facing the rotation direction detector; and a controller configured to perform a first positioning control of the rod in a sliding direction thereof based on a displacement amount from the axial direction detector, and a second positioning control of the rod in a rotation direction thereof based on an angular movement amount from the rotation direction detector.

16. The fluid pressure actuator of claim 15, further comprising:

a guide flange connected to the cylinder and configured to guide rotation of the piston body in a rotation direction thereof, wherein the first piston head is configured to slide in the cylinder.

17. The fluid pressure actuator of claim 15, further comprising:

a servo valve connected to the cylinder; and a rotation motor separately provided from the cylinder, wherein the controller is configured to control the servo valve to perform the first positioning control based on the displacement amount and control the rotation motor to perform the second positioning control based on the angular movement amount.

18. The fluid pressure actuator of claim 15, wherein the axial direction scale and the axial direction detector form an axial direction sensor, the axial direction scale attached to the rod, the axial direction detector configured to detect signal reflected from the axial direction scale and output a first detection signal indicating a displacement distance, and the rotation direction scale and the rotation direction detector form a rotation direction sensor, the rotation direction scale configured to rotate about a same axis as the piston body, the rotation direction detector configured to detect signal reflected from the rotation direction scale and output a second detection signal indicating the angular movement amount.

19. The fluid pressure actuator of claim 18, wherein the rotation direction sensor and the axial direction sensor are integrally provided as an axial direction and rotational direction sensor, and the axial direction and rotational direction sensor includes an axial direction and rotation direction scale and an axial direction and rotation direction detector.

* * * * *